US006233423B1

(12) United States Patent
Fletcher et al.

(10) Patent No.: US 6,233,423 B1
(45) Date of Patent: May 15, 2001

(54) TRANSFER APPARATUS WITH DUAL TRANSFER-ASSIST BLADES

(75) Inventors: Gerald M. Fletcher, Pittsford; Christian O. Abreu, Rochester; John T. Buzzelli, Walworth; Palghat S. Ramesh, Pittsford, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/556,449

(22) Filed: Apr. 24, 2000

(51) Int. Cl.[7] ..... G03G 15/16
(52) U.S. Cl. ..... 399/310; 399/314
(58) Field of Search ..... 399/310, 311, 399/312, 313, 170, 172, 121

(56) References Cited

U.S. PATENT DOCUMENTS 5,568,238 10/1996 Osbourne et al. ..... 355/274
5,594,538 * 1/1997 Takekoshi et al. ..... 399/310
5,697,030 * 12/1997 Hayasgi et al. ..... 399/299
5,713,066 * 1/1998 Takekoshi et al. ..... 399/121
5,923,921 7/1999 OuYang et al. ..... 399/66

FOREIGN PATENT DOCUMENTS 8-314296 * 11/1996 (JP) .

* cited by examiner

*Primary Examiner*—Quana M. Grainger

(57) ABSTRACT

A transfer charging device is arranged with dual transfer-assist blades consisting of a pressure blade and a halo blade. The pressure blade is arranged for contacting and thereby urging a substrate against an image-bearing photoreceptor. The pressure blade is formed of a relatively conductive material. The halo blade is formed of a dielectric material. The halo blade is positioned between the transfer charging device and the pressure blade to shield the pressure blade from being charged-up by the transfer charging device.

24 Claims, 2 Drawing Sheets

TRANSFER APPARATUS WITH DUAL TRANSFER-ASSIST BLADES

FIELD OF THE INVENTION

This invention relates in general to electrophotographic printing and, more specifically, to a transfer apparatus with dual transfer-assist blades.

BACKGROUND OF THE INVENTION

Electrostatographic printing is well known and is commonly used in making photocopies of an original document. See, generally, R. M. Schaffert, "Electrophotography," The Focal Press, New York, 1965.

Electrostatographic printing includes the well-known process of transfer. In transfer, charged toner particles from an image-bearing photoreceptor member are transferred to an image support substrate, such as a copy sheet. Transfer is accomplished at a transfer station, wherein the transfer occurs by electrostatically overcoming adhesive forces holding the toner particles to the image-bearing member, thus transferring the developed toner image to the substrate.

In conventional electrostatographic machines, transfer is achieved by transporting the image support substrate into the area of the transfer station. The transfer station applies electrostatic force fields sufficient to overcome the adhesive forces holding the toner to the photoreceptor surface in order to attract and transfer the toner particles onto the image support substrate. In general, such electrostatic force fields are generated by means of electrostatic induction using a corona-generating device such as, for example, a dicorotron. The copy sheet is placed in direct contact with the developed toner image on the photoreceptor surface while the reverse side of the copy sheet is exposed to a corona discharge. This corona discharge generates ions having a polarity opposite to that of the toner particles, thereby electrostatically attracting and transferring the toner particles from the photoreceptive member to the image support substrate.

During electrostatic transfer of a toner image to a copy sheet, it is important for the copy sheet to be held in direct, uniform and intimate contact with the photoconductive surface and the toner image developed thereon. Unfortunately, however, the interface between the photoreceptive surface and the copy substrate is not always optimal. Various substrate conditions such as copy sheets being mishandled, wrinkled, creased, left exposed to the environment, or previously processed by a heat and pressure fusing or fixing operation, result in insufficient substrate contact with the photoreceptor surface during transfer. This substrate condition creates spaces or air gaps between the developed image on the photoreceptor surface and the copy sheet. The air gaps, in turn, impair transfer of the toner image, thus causing copy defects.

It is known to use transfer-assist pressure blades in the transfer process. Such transfer-assist pressure blades mechanically press the copy substrate into substantially uniform intimate contact with the image-bearing surface, just prior to the build-up of the transfer electrostatic field. Moreover, by flattening the substrate against the photoreceptor, the transfer-assist pressure blade thus eliminates the foregoing air break-down caused by substrate cockle. A further purpose of the transfer-assist pressure blade is to reshape and optimize the transfer field profile under the transfer charging device. Some examples of transfer-assist pressure blades may be found in U.S. Pat. No. 5,923,921 to William M. OuYang, et al., and references cited therein. See also, U.S. Pat. No. 5,568,238 to William G. Osbourne, et al., and references cited therein. One example of a current transfer-assist pressure blade consists of a single pressure blade made of a dielectric material.

As noted in the foregoing William G. Osbourne et al. patent, it is known that electrostatic interaction may occur between the transfer-assist pressure blade member and the copy substrate. This is because the transfer-assist pressure blade is located in the transfer zone between the transfer corona-generating device such as, for example a dicorotron, and the photoreceptor. As a result, a measurable electrostatic charge is imparted on the blade member by the transfer dicorotron. Once the transfer-assist pressure blade is charged, it repels any additional charges away from itself, thus leaving a small area that is devoid of charge on the copy substrate adjacent to the transfer-assist pressure blade tip. As explained below, this unwanted electrostatic charge on the pressure blade causes a problem in multiple-toner color printing known as "toner drag out".

As is known, color printing may be achieved by using multiple layers of different colored toners. In a typical color process, for example, three colored toners are used, comprising magenta, yellow and cyan. In a typical three-layer image, the top cyan layer is relatively low-charged compared to the layers below it, or to the charge of one-layer and two-layer images. The low charge on the cyan image, together with its relatively far distance from the photoreceptor, cause the cyan image to be susceptible to forces which may pull the cyan away from the image charge on the photoreceptor.

When the image/substrate/photoreceptor "sandwich" passes under the charged transfer-assist pressure blade, the "fluffy" cyan layer is attracted both to the unwanted charge on the transfer-assist pressure blade and to the image charge on the photoreceptor. Next, the image passes under the substrate charge void area adjacent to the transfer-assist pressure blade. Here the attraction force of the cyan layer to the charged transfer-assist pressure blade overcomes the electrostatic photoreceptor image force. Because the transfer dicorotron has not sufficiently charged the substrate to overcome the electrostatic forces of either the charged image or the charged transfer-assist pressure blade, a tangential transfer-assist pressure blade electrostatic force causes the image to be "dragged out" in the upstream process direction. Here "tangential" indicates the direction parallel to the process direction.

It will be understood that this toner drag-out problem is primarily related to the top toner layer of the multi-layer toner image. Thus, when the top toner layer is cyan, this problem is known as transfer "cyan drag out". Moreover, in another hypothetical multi-layer toner image with magenta as the top layer, this problem is known as transfer "magenta drag out".

As a result, to solve the problem of "toner drag out", there is a need for an improved transfer apparatus that substantially eliminates the unwanted electrostatic charge on the transfer-assist pressure blade.

DETAILED DESCRIPTION OF THE PREFERRED EMBODIMENTS

In brief, electrostatographic printing transfer apparatus is arranged for reducing electrostatic charge build-up on a transfer-assist blade. The transfer apparatus comprises a transfer charging device arranged with dual transfer-assist blades. The dual transfer-assist blades comprise a first, "pressure blade" 30 and a second, "halo blade". The pressure blade is arranged for urging a substrate against a toner image-bearing photoreceptor. The halo blade is positioned between the transfer charging device and the pressure blade to shield the pressure blade from being charged-up by the transfer charging device.

Figure 1:
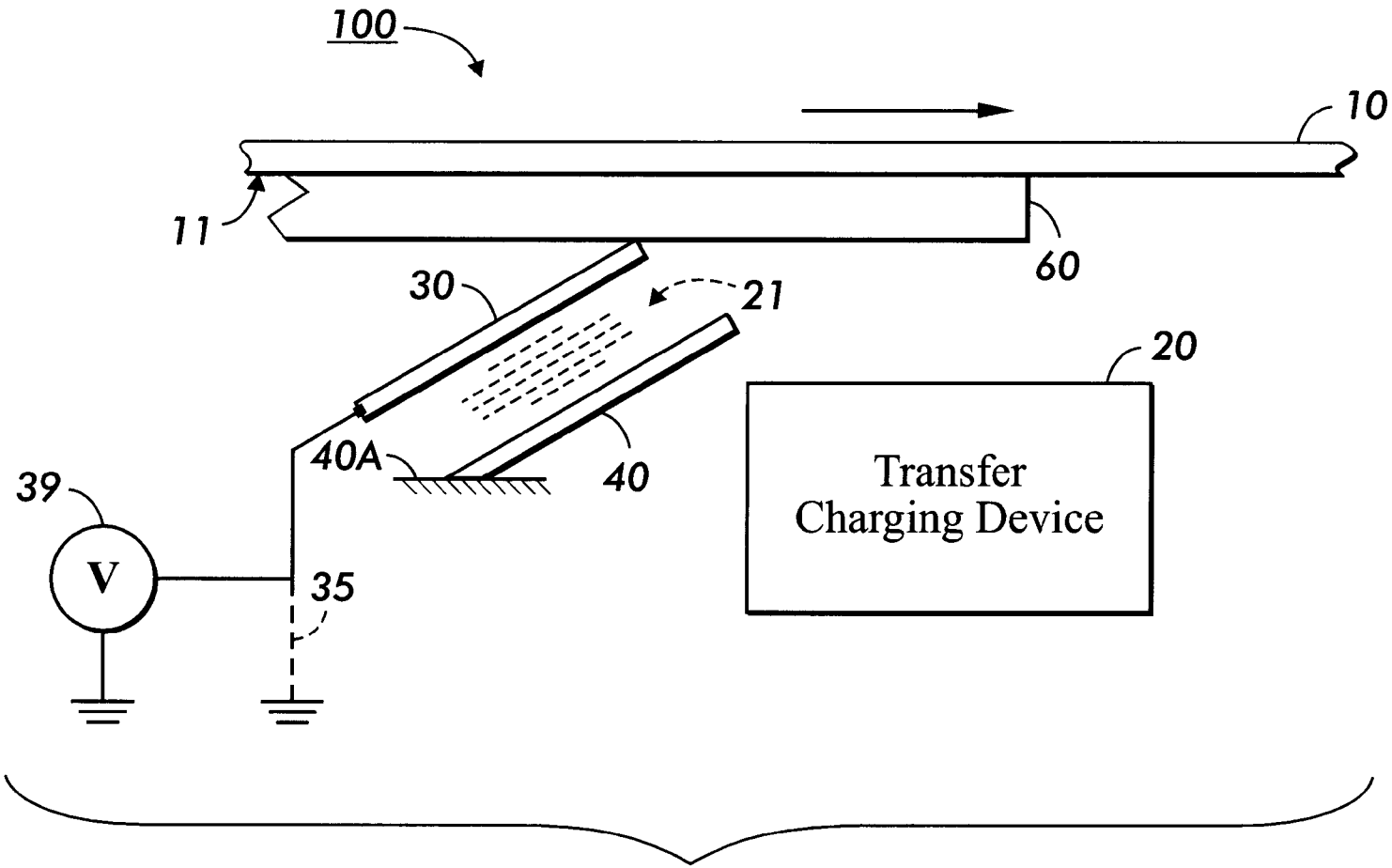
FIG. 1 depicts one embodiment of transfer apparatus 100 with dual transfer-assist blades, in accordance with the present invention.

Referring now to FIG. 1, there is depicted a transfer apparatus with dual transfer-assist blades, in accordance with the present invention, the transfer apparatus generally denoted by reference number 100. As shown, apparatus 100 comprises a transfer charging device 20 arranged with dual transfer-assist blades 30 and 40. The dual transfer-assist blades comprise a pressure blade 30 and a halo blade 40.

Also shown in FIG. 1 is a photoreceptor 10 bearing a developed toner image 11. As is known, prior to transfer the developed toner image 11 is charged to a pre-transfer voltage by means of a pre-transfer charging device (not shown in FIG. 1).

Also shown is a substrate 60.

In one embodiment, the developed toner image 11 comprises a three-toner layer color image. In one embodiment, the top toner layer of the tree-toner layer color image comprises cyan.

As shown in FIG. 1, the pressure blade 30 is arranged for contacting and thereby urging the substrate 60 against the photoreceptor 10.

The pressure blade 30 comprises a relatively conductive material comprising a resistivity of about 100 million ohms per square. One key property of the pressure blade 30 is its relative conductivity. This is because increasing blade 30's conductivity would cause current leakage with moist substrates, while decreasing blade 30's conductivity would cause additional charging, resulting in copy defects.

In one embodiment, the pressure blade 30 is coupled to a bias voltage 39 that is substantially equal to the pre-transfer voltage of the developed toner image 11.

In another embodiment, the pressure blade 30 is coupled to ground 35.

Still referring to FIG. 1, the halo blade 40 comprises a dielectric material comprising a resistivity of about 1,000 trillion ohms per square, thus providing a halo blade 40 surface which can be charged for field shaping under the dicorotron 20.

As shown, the halo blade 40 is positioned in the transfer electrostatic field between the transfer charging device 20 and the pressure blade 30. The halo blade 40 is physically fixed in a stationary position by any convenient means, depicted in FIG. 1 by element 40A. As shown, the halo blade 40 is spaced slightly away from and slightly ahead of the pressure blade 30. Also as shown in FIG. 1, the halo blade 40 does not contact the photoreceptor 10 or the substrate 60.

In operation, the transfer charging device 20 initially charges the halo blade 40. After becoming charged-up, the halo blade 40 performs two functions:

First, the halo blade 40 repels any further charges, thus maintaining the electrostatic field 21 profile shaping as provided by current transfer apparatus comprising only a single transfer-assist blade.

Second, because the halo blade 40 is located between the pressure blade 30 and the transfer charging device 20, the halo blade 40 acts to shield the pressure blade 30 from being charged by the transfer charging device 20. Because the pressure blade 30 does not charge-up, there is no tangential field to drag out the top toner layer.

In one embodiment, the halo blade 40 is insulated.

In one embodiment, the transfer charging device 20 comprises a dicorotron.

In summary, as a result of the present invention, the unwanted electrostatic charge on the pressure blade 30 is substantially eliminated. As a result, the cyan toner is not attracted to the pressure blade 30, thus preventing cyan drag out.

Figure 2:
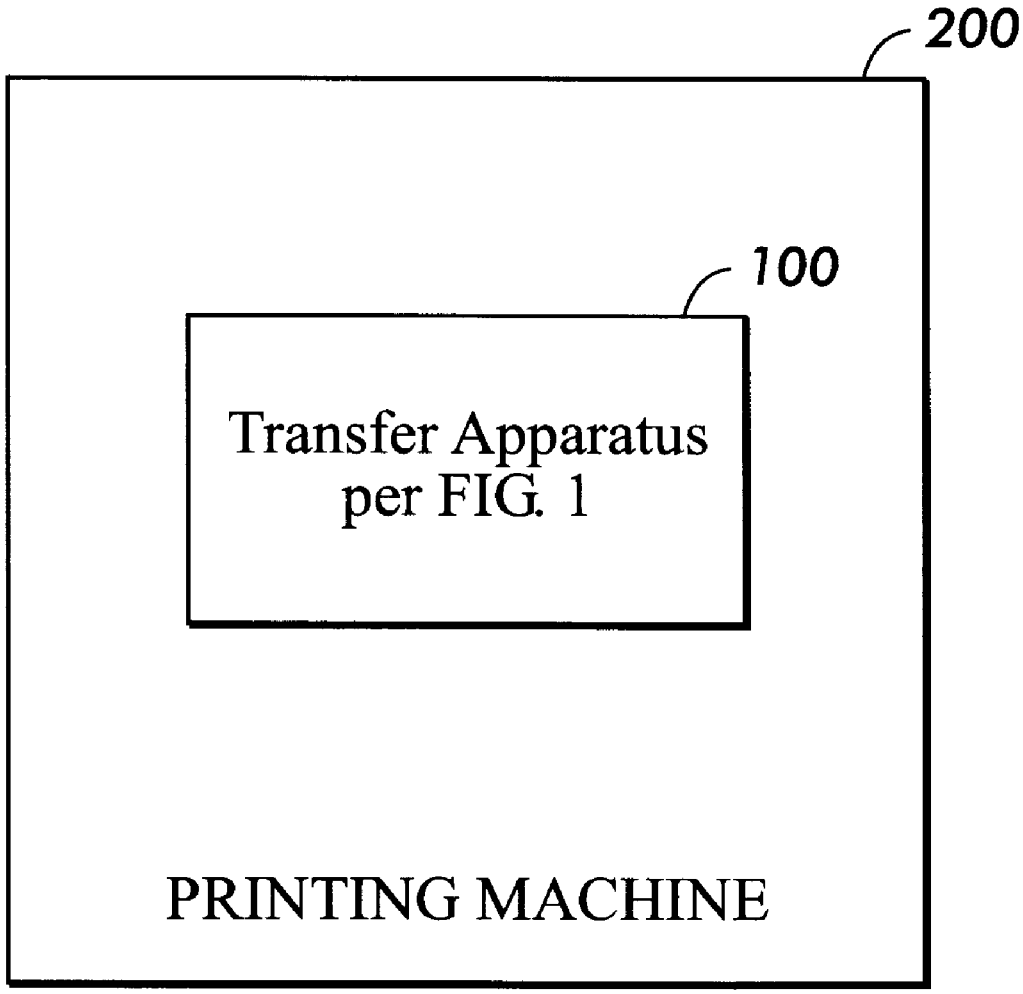
FIG. 2 depicts a printing machine with the transfer apparatus 100 of FIG. 1.

Referring now to FIG. 2, there is shown a printing machine 200 comprising the transfer apparatus with dual transfer-assist blades 100. It will be understood the transfer apparatus 100 is identical to that which is depicted in FIG. 1 and described hereinabove.

While various embodiments of transfer apparatus with dual transfer-assist blades, in accordance with the present invention, have been described hereinabove, the scope of the invention is defined by the following claims.

What is claimed is:

1. Transfer apparatus comprising a transfer charging device and dual transfer-assist blades, the dual transfer-assist blades comprising a pressure blade and a halo blade, the pressure blade arranged for contacting and thereby urging a substrate against an image-bearing photoreceptor, the halo blade being positioned between the transfer charging device and the pressure blade, thus reducing pressure blade charging by the transfer charging device, where the halo blade does not contact the image-bearing photoreceptor or the substrate.

2. The transfer apparatus of claim 1, the halo blade being insulated.

3. The transfer apparatus of claim 1, the image comprising a 3-toner layer color image.

4. The transfer apparatus of claim 1, the charging device comprising a dicorotron.

5. The transfer apparatus of claim 1, the halo blade spaced slightly away from and slightly ahead of the pressure blade.

6. Transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the halo blade comprising a dielectric material.

7. The transfer apparatus of claim 6, the dielectric material comprising a resistivity of about 1,000 trillion ohms per square.

8. Transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade comprising a relatively conductive material.

9. The transfer apparatus of claim 8, the relatively conductive material comprising a resistivity of about 100 million ohms per square.

10. Transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade being coupled to ground.

11. Transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade coupled to a bias voltage.

12. The transfer apparatus of claim 11, the image being charged to a pre-transfer voltage, the bias voltage substantially equal to the pre-transfer voltage.

13. A printing machine comprising transfer apparatus, the transfer apparatus comprising a transfer charging device and dual transfer-assist blades, the dual transfer-assist blades comprising a pressure blade and a halo blade, the pressure blade arranged for contacting and thereby urging a substrate against an image-bearing photoreceptor, the halo blade being positioned between the transfer charging device and the pressure blade, thus reducing pressure blade charging by the transfer charging device, where the halo blade does not contact the image-bearing photoreceptor or the substrate.

14. The printing machine of claim 13, the halo blade being insulated.

15. The printing machine of claim 13, the image comprising a 3-toner layer color image.

16. The printing machine of claim 13, the charging device comprising a dicorotron.

17. The printing machine of claim 13, the halo blade spaced slightly away from and slightly ahead of the pressure blade.

18. A printing machine comprising transfer apparatus, the transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the halo blade comprising a dielectric material.

19. A printing machine comprising transfer apparatus, the transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the dielectric material comprising a resistivity of about 1,000 trillion ohms per square.

20. A printing machine comprising transfer apparatus, the transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade comprising a relatively conductive material.

21. The printing machine of claim 20, the relatively conductive material comprising a resistivity of about 100 million ohms per square.

22. A printing machine comprising transfer apparatus, the transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade being coupled to ground.

23. A printing machine comprising transfer apparatus, the transfer apparatus comprising a transfer charging device and dual transfer-assist blades, the dual transfer-assist blades comprising a pressure blade and a halo blade, the pressure blade arranged for urging a substrate against an image-bearing photoreceptor, the halo blade being positioned between the transfer charging device and the pressure blade, thus reducing pressure blade charging by the transfer charging device, the pressure blade coupled to a bias voltage.

24. The printing machine of claim 23, the image being charged to a pre-transfer voltage, the bias voltage substantially equal to the pre-transfer voltage.

* * * * *